US005179406A

United States Patent [19]

Nakamura

[11] Patent Number: 5,179,406

[45] Date of Patent: Jan. 12, 1993

[54] APPARATUS FOR TREATING A PHOTOSENSITIVE MATERIAL AND METHOD OF ADDING WATER FOR USE THEREIN

[75] Inventor: Takashi Nakamura, Kanagawa, Japan

[73] Assignee: Fuji Photo Film Co., Ltd., Kanagawa, Japan

[21] Appl. No.: 689,562

[22] Filed: Apr. 23, 1991

[30] Foreign Application Priority Data

Apr. 26, 1990 [JP] Japan ..... 2-111455

[51] Int. Cl.[5] ..... G03D 3/02

[52] U.S. Cl. ..... 354/324

[58] Field of Search ..... 354/319, 322, 323, 324, 354/298, 317, 320

[56] References Cited

FOREIGN PATENT DOCUMENTS 1-254959 10/1989 Japan .
1-254960 10/1989 Japan .
1-281446 11/1989 Japan .
2-52343 2/1990 Japan .

*Primary Examiner*—Michael L. Gellner
*Assistant Examiner*—D. Rutledge
*Attorney, Agent, or Firm*—Sughrue, Mion, Zinn, Macpeak & Seas

[57] ABSTRACT

The following is disclosed: an apparatus for treating photosensitive material and a method for the implementation of the same, in which the water amount which evaporated from each treating tank is supplied so as to hold the concentration of the treating solution constant, and a method of adding the water in the same, in which, when a replenished solution is added into the treating tank to recover from treating solution fatigue, a time which has passed after the overflow of the treating solution from the treating tank is stopped is evaluated, it is determined whether the evaluated time equals a predetermined period of time or not and, when determined yes, a predetermined amount of water is supplied into the treating tank.

16 Claims, 8 Drawing Sheets

APPARATUS FOR TREATING A PHOTOSENSITIVE MATERIAL AND METHOD OF ADDING WATER FOR USE THEREIN

BACKGROUND OF THE INVENTION a) Field of the Invention

The present invention relates to an apparatus for treating a photosensitive material and a method of adding water into the same apparatus, in which the concentration of a treating solution accommodated within a treating tank of the apparatus is held constant.

b) Description of the Related Art

In an automatic developing machine, which forms part of the apparatus for treating the photosensitive material, a developing tank, bleaching tank, fixing tank, rinsing tank and a stabilizing tank are provided each respectively storing a developing solution, bleaching solution, fixing solution, rinsing solution and a stabilizing solution, (hereinafter generally referred to as a treating solution). The photosensitive material, which has been subjected to a printing procedure, is sequentially immersed into each of the treating tanks and, after being developed, it is introduced to a drying unit where it is dried prior to being withdrawn.

Since the treating solution is withdrawn by conveying the photosensitive material and is also decreased due to evaporation loss, it is necessary to replenish the loss as the throughput of the photosensitive material is increased. Incidentally, the amount of solution withdrawn by this photosensitive material can be readily calculated from the throughput of the photosensitive material. Meanwhile, as regards the above-described decrease of the treating solution due to evaporation loss, since the water content within the treating solution is decreased, the concentration of the treating solution is changed. Therefore, it is necessary to add an amount of water corresponding to the loss independently of the replenishing solution. However, the evaporation loss cannot be definably determined by calculation because it varies with the surrounding environment, such as temperature and humidity, and further depending on whether the apparatus is in an operating or shut down condition.

Accordingly, it is proposed to provide a level sensor, such as a gravimeter or the like, within each treating tank and add water based on a value, detected by this level sensor (see, for example, Japanese Patent Application Laid-Open No. 1-281446), according to which the changing concentration of the treating solution can be detected by the level sensor so that an appropriate amount of water can be added.

Nevertheless, the operating reliability of the level sensor is low and it often operates erroneously, often making the addition of an inappropriate amount of water possible. This is also true of the concentration sensor. In addition, these sensors are costly and lack serviceability. As a result, it is proposed to provide a monitoring treating tank that is independent of the actual treating tank and add water therein based on the evaporation loss of the latter (see Japanese Patent Application Laid-Open Nos. 1-254959 and 1-254960). Accordingly, operating reliability is increased because data approximating the actual evaporation loss can be obtained.

However, in the above-described water adding system, since the monitoring treating tank is independent of the actual treating tank, the entire apparatus becomes bulky and the number of parts required increase. In addition, in order to set similar conditions as in the actual treating tank, management and maintenance become complicated.

SUMMARY OF THE INVENTION

In view of the above-described circumstances, an object of the present invention is to provide an apparatus for treating photosensitive material and a method of adding water for use therein, which will eliminate a unit for detecting evaporation loss from the apparatus itself and which supplies a reliable and proper amount of water while improving manageability and maintainability.

The present invention concerns a method of adding water into the treating tank of the apparatus for treating photosensitive material comprising the steps of:

determining, as a replenishing solution is being added to the treating tank, whether an overflow of the solution occurs or not; and supplying a predetermined amount of water into the treating tank as the overflow is not detected.

According to the above-described arrangement of the present invention, since the detected overflow means that the treating solution within the treating tank has been filled by a predefined amount, it is not necessary to supply more water. Meanwhile, if the replenishing solution is properly added and the level of the treating solution is not deficient, since this shortage corresponds to evaporation loss, water may be added until it overflows. Also in this case, if the treating solution which has overflown from the treating tank is detected by a flowrate meter or the like, that is, it is determined whether the water has overflown or not. Water may then be added without excess or shortage.

In addition, the present invention comprises the steps of:

previously setting an amount of water to be added to the treating tank, which corresponds to the overflow of the treating solution from the treating tank;

integrating an overflow of the treating solution from the treating tank;

evaluating an amount of water to be supplied to the treating tank from the integrated overflow; and supplying the same amount of water as the evaluated amount of water to be supplied into the treating tank.

With changing environmental conditions, for example, the temperature or humidity of the air surrounding the apparatus, the strength of the air conditioning wind passing therethrough, and the extent of ventilation of the upper part of the treatment tank positioned inside the apparatus, evaporation loss of water within the treating tank is changed and the overflow is also correspondingly changed. Therefore, as also described below, the overflow of the treating solution from the treating tank may be integrated to evaluate the amount of water to be supplied to the treating tank from this integrated value, by which, as compared with supplying the predetermined amount of water, a more appropriate amount of water may be supplied.

A relationship between the integrated overflow value and the amount of water to be supplied is hereinafter described. First, as shown in FIG. 6A, when the photosensitive material is continuously treated under normal conditions, since the replenishing solution corresponding to the throughput of the photosensitive material is supplied, an overflow corresponding to the replenished amount takes place. However, as indicated by a chain line in FIG. 6A, if, due to changing environmental conditions, the evaporation loss of water within the treating tank increase or if the predefined amount of the replenishing solution is not supplied, overflow does not take place. Since the concentration of the treating solution is also correspondingly changed, the amount of water to be added must be increased. In addition, as shown in FIG. 6B, when the photosensitive material is intermittently treated, since the evaporation loss of water within the treating tank takes place while the photosensitive material is not being treated, overflow may not take place during treatment. Since the concentration of the treating solution also changes, the amount of water to be added must be correspondingly increased. Therefore, the overflow of the treating solution in a predetermined period of time may be integrated and the concentration of the treating solution can be held constant by setting the amount of the solution to be added so that, the less the integrated overflow is, the more solution is added.

FIG. 6C shows three kinds of overflow each corresponding to the absence of overflow when there is throughput for the day when there is a large amount of overflow observed when the throughput for the day is great and a small amount of overflow observed when the throughput for the day is small.

Still further, the present invention relates to an apparatus for treating the photosensitive material comprising a treating tank for accommodating the treating solution for treating the photosensitive material, an overflow tank for accommodating the overflow of the treating solution accommodated within the tank, a delivery means for delivering the overflow of the treating solution toward the overflow tank and a detecting means disposed inside of the delivery means for detecting either the presence or absence or the flowrate of the treating solution which passes through the interior of the delivery means.

According to the above-described arrangement of the invention, excess treating solution accommodated within the treating tank is delivered into the overflow tank through an overflow line. Since a flowrate meter is provided within the overflow line, it is possible to detect the presence or absence and the flowrate of the treating solution flowing out toward the overflow tank. Since the detected overflow means that the treating solution within the treating tank has been filled in the predefined amount, it is possible to determine if the level of the treating solution within the treating tank reached the predefined value. As a result, it becomes unnecessary to detect the surface level of the treating solution by the mechanical motion of the float or the like within the treating tank to thereby achieve an improvement in accuracy of detecting the surface level.

In addition, when the solution is properly replenished and the surface level of the treating solution is not sufficient, this shortage corresponds to evaporation loss, so that water may be added until it overflows. Also in this case, if the treating solution which has overflown out of the treating tank is detected by a flowrate meter or the like, that is, it is determined whether it has overflown or not, it is possible to add the correct amount of treating solution. We can use any flow rate meter or overflow detect device as a flow rate meter or the like. For example, rotor type, honneycum type, thermosensor type, magnetic liquid type and so on.

The present invention relates to an apparatus for treating photosensitive material comprising:

a treating tank for accommodating the treating solution which treats the photosensitive material;

a sensor means for detecting whether the treating solution has overflown out of the treating tank or not;

a determining means for determining based on the above-described results detected by the sensor means whether the overflow was detected or not over a predetermined period of time; and a supply means for supplying a predefined amount of water into the treating tank when it has been determined that, over the predefined period of time, the overflow could not be detected by the determining means.

According to the above-described arrangement of the invention, if it is determined by the determining means that the overflow was not detected over the predefined period of time by the sensor means, then it means that the surface level of the treating solution is deficient due to the evaporation loss of water within the treating tank. So a predetermined amount of water is supplied to the treating tank means of the supply means. Also in this case, if the sensor means detects that overflow took place, then the proper amount of water may be added.

. In addition, the present invention relates to an apparatus for treating the photosensitive material comprising a treating tank for accommodating the treating solution that treats the photosensitive material, an accommodating means for previously accommodating an amount of water to be supplied which corresponds to the overflow of the treating solution out of the treating tank, an integrating means for integrating the overflow of the treating solution which has overflown out of the treating tank, a measuring means for evaluating the period of time which has passed after the adding of water is completed, a determining means for determining whether the time that has passed which was evaluated by the measuring means, added up to a predetermined time or not, a calculating means for evaluating an amount of water to be supplied, which corresponds to the overflow integrated by the integrating means, based on the content accommodated within the accommodating means, as was determined by the determining means that the predetermined that the period of time had passed and a supply means for supplying the same amount of water as the amount evaluated by the calculating means to the treating tank.

According to the above-described arrangement of the invention, since with changing environmental conditions surrounding the apparatus, the evaporation loss of water within the treating tank is changed and overflow is also correspondingly changed, the overflow out of the treating tank may be integrated over a predetermined period of time by the integrating means starting from the moment that the supply of water has been completed to evaluate the amount of water to be supplied from data on the amount of water to be supplied, which correspond to the overflow out of the treating tank, which was previously accommodated within the accommodating means, by the calculating means to supply the water by means of the supply means, so that, as compared with a case in which a predetermined amount of water is supplied to the treating tank, a more appropriate amount of water may be supplied.

As described above, the apparatus and the method of adding water implemented in that apparatus according to the present invention have some advantages in that a highly reliable and correct amount of water can be obtained without providing equipment for detecting the evaporation loss in the apparatus itself while its manageability and maintainability can be improved.

DETAILED DESCRIPTION OF THE PREFERRED EMBODIMENT

Figure 1:
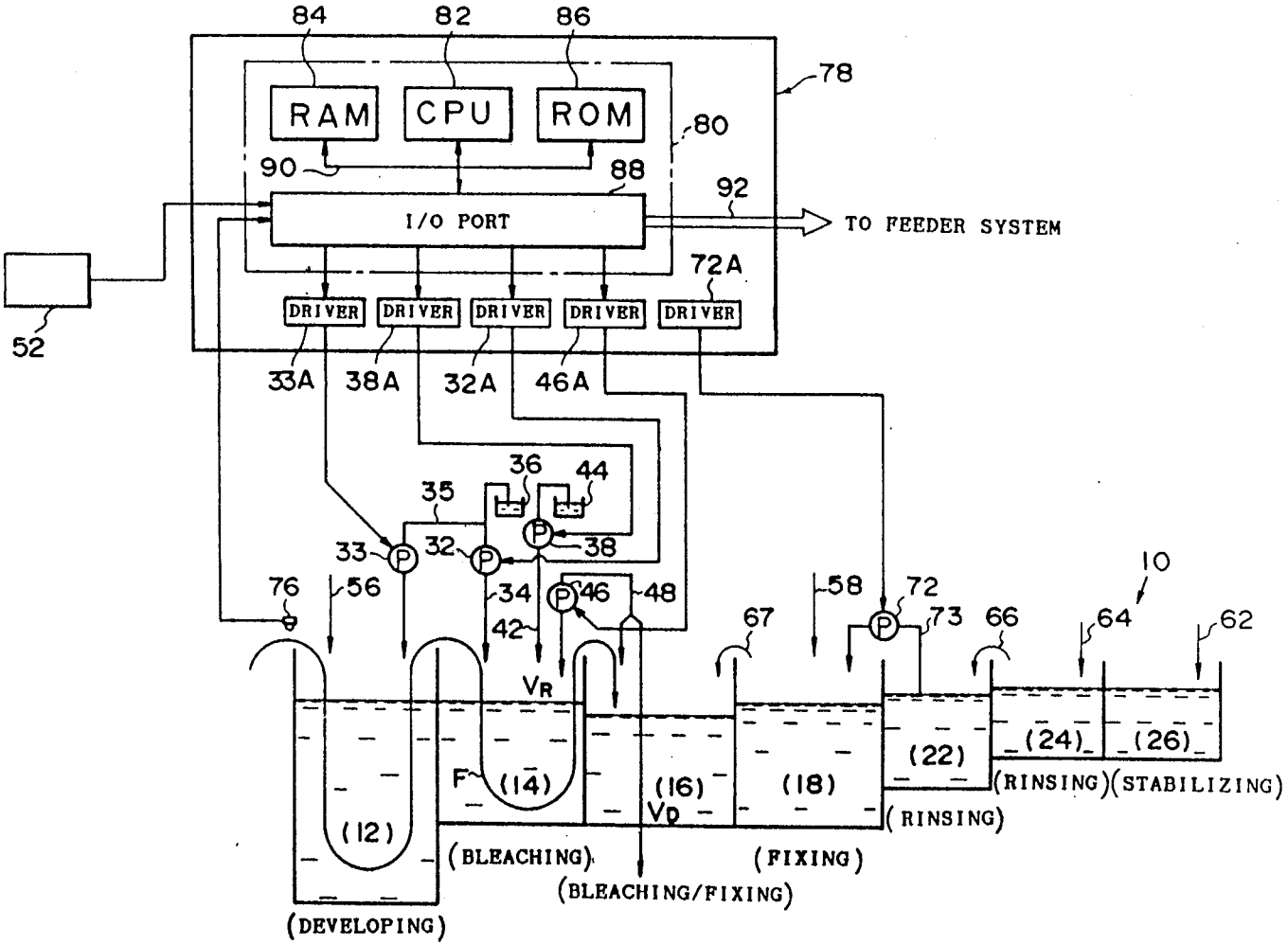
FIG. 1 is a schematic cross-sectional view illustrating an automatic developing machine embodying the present invention.

In FIG. 1, an automatic developing machine, which acts as the apparatus according to the present invention, is shown, in which a developing tank 12, a bleaching tank 14, a bleaching/fixing tank 16, a fixing tank 18, rinsing tanks 22, 24 and a stabilizing tank 26 are each disposed in series each accommodating a developing solution, a bleaching solution, a bleaching/fixing solution, a rinsing solution and a stabilizing solution therein in a predefined amount. A photosensitive material F is sequentially fed into these treating tanks (hereinafter generally referred to merely as the treating tank (10) by means of a feeding system (not shown). This feeding system is controlled by a control unit 78, to which is connected a signal line of a sensor 76 provided at the inlet of the developing tank for detecting the passage of photosensitive material F so that the control unit 78 may detect whether the photosensitive material F is present or not.

As shown in FIG. 1, disposed adjacent to the treating tank 10 is a water tank 36, which is in communication with the bleaching tank 14 via a line 34. Interposed at an intermediate portion of the line 34 is a pump 32 driven and controlled by the control unit 78 so that by driving the pump 32 water is supplied to the bleaching tank 14. In addition, disposed adjacent to the water tank 36 is a replenishing water tank 44, which is in communication with the bleaching tank 14 via a line 42. Interposed at an intermediate portion of this line 42 is a pump 38 driven and controlled by the control unit 78, so that, as in the above-described water supplying, the replenished bleaching solution may be added to the bleaching tank 14 by driving the pump 38.

Incidentally, a branch line 35 is provided upstream from the pump 32 and communicates with line 34 for replenishing water to the bleaching tank 14. This branch line 35 extends toward the developing tank 12. Interposed at an intermediate portion of the branch line 35 is a pump 33 driven and controlled by the control unit 78, so that the driving of the pump 33 causes water to be supplied into the developing tank 12.

Respectively provided at the developing tank 12, the fixing tank 18 and the stabilizing tank 26, which are treating tanks other than the above-described bleaching tank 14, are lines 56, 58 and 62 for supplying the replenished treating solution. In addition, disposed at the rinsing tank 24 is a water supply line 64 to replenish rinsing water. From the rinsing tank 24 the rinsing water is fed to the rinsing tank 22 by means of an overflow 66 while, from the fixing tank 18, the fixing solution is fed to the bleaching/fixing tank 16 by means of an overflow 67. The rinsing water within the rinsing tank 22 is fed toward the fixing tank 18 by means of a pump 72 and a line 73. Incidentally, the driving of this pump 72 is also controlled by the above-described control unit 78.

Figure 2:
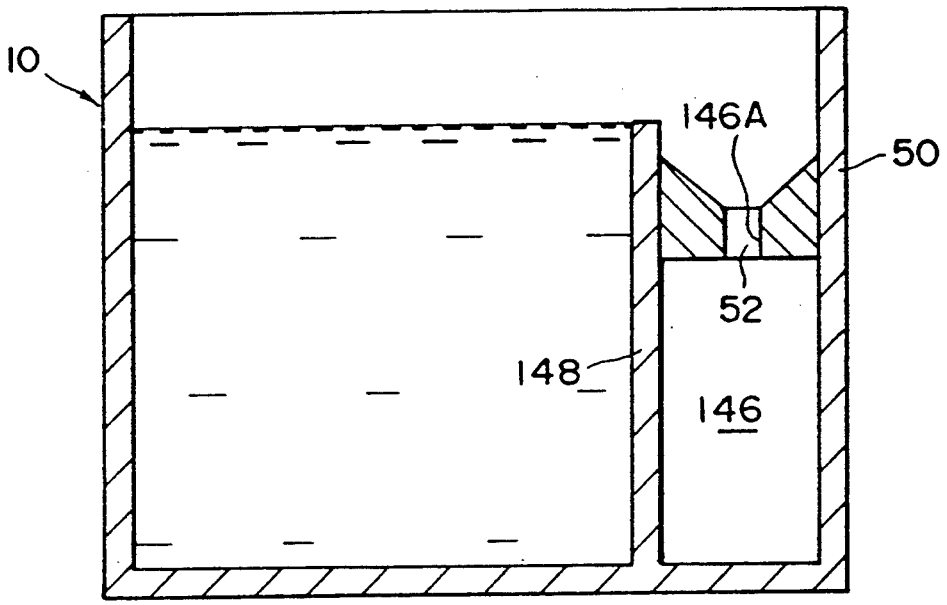
FIG. 2 is a schematic view of an overflow tank which is provided adjacent to a treating tank.

As shown in FIG. 2, an overflow tank 146 is provided adjacent to each treating tank 10. Erected between the overflow tank 146 and the treating tank 10 is a vertical wall 148 to partition the treating tank 10 and the overflow tank 146. The height of the vertical wall 148 is set lower than a lateral wall 50 of the treating tank 10. The treating solution within the treating tank 10 flows out toward the overflow tank 146 over this vertical wall 148. At this overflow tank 146, a throttle portion 146A for collecting the treating solution which has overflown and serves as an overflow line, is formed. A flowmeter 52 is disposed thereto. This flowmeter 52 is disposed along the stream of flow of the treating solution from the overflow tank 146. The flowmeter 52 is connected to the control unit 78.

As shown in FIG. 1, the control unit 78 includes a microcomputer 80, which comprises a CPU 82, a RAM 84, a ROM 86, an I/O port 88 and buses 90 for connecting them to data buses control buses or the like. The above-described pumps 32, 33, 38, 46 and 72 are respectively connected to the I/O port 88 via drivers 32A, 33A, 38A, 46A and 72A. Also connected to this I/O port 88 are the sensor 76 and the flowmeter 52. Still further, a signal line 92 is connected to this I/O port 88 for transmitting a signal to the feeding system.

Within RAM 84 of the microcomputer 80, flowrates detected by the flowmeter 52 are calculated for storage and, over a predetermined period of time after the addition of water is completed, its integrated flowrate is read out to infer the amount of water to be added. In this embodiment, when the integrated flowrate equals zero over the predetermined period of time, a predetermined amount of water may be added.

Figure 3A:
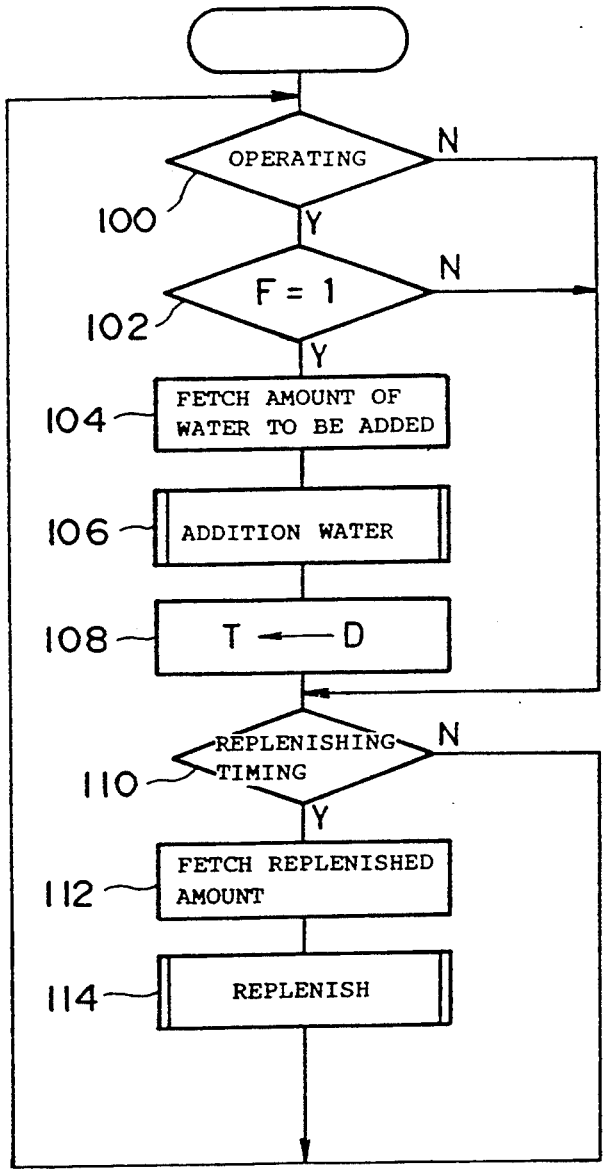
FIG. 3A is a flowchart illustrating a control routine according to the present embodiment for controlling the operation.
Figure 3B:
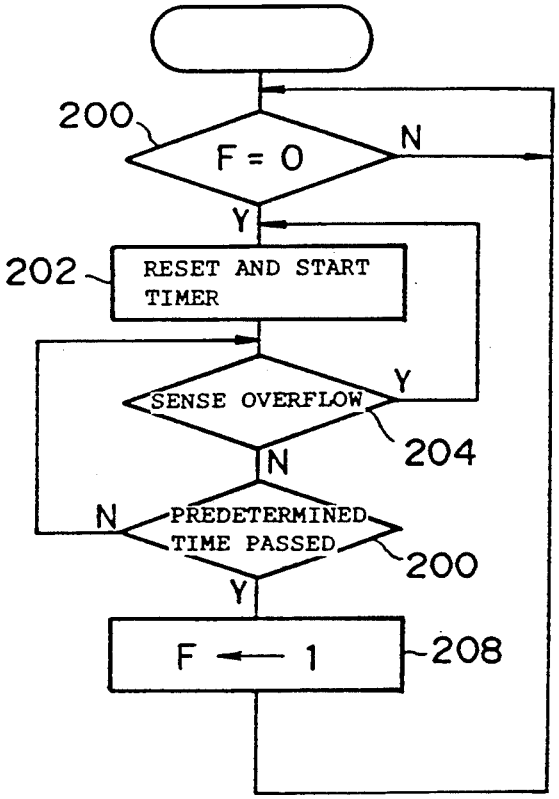
FIG. 3B is a flowchart illustrating a routine according to the present embodiment for determining whether water should be added or not.

In addition, stored within ROM 86 of the microcomputer 80 is a program for replenishing the replenishing water and a water adding program, as shown in FIGS. 3A and 3B. The replenishing water program and the water adding program may be alternately processed for each predetermined period of time while the apparatus is operating. Only the water adding program is executed while the apparatus is shut down. Alternatively, these programs may be concurrently processed using two CPUs.

Next, the operation of this embodiment will be described with reference to the control flowcharts of FIGS. 3A and 3B.

The photosensitive material F is sequentially introduced from the developing tank 12 through the bleaching tank 14 to the bleaching/fixing tank 16, where treatments such as developing and bleaching and the like are conducted and, after being withdrawn from the stabilizing tank 26, it is dried.

First, the control routine for the operating time as shown in FIG. 3A is referred to. In step 100, it is determined whether the apparatus is currently operating or not. If yes, the procedure moves to step 102 where it is determined whether a flag F is set (1) or not. This flag F is one for discriminating whether water should be added or not (described later). In step 102, if it is determined in the affirmative, that is, it is determined that water should be added, then the procedure moves to step 104 where a value from RAM 84 is fetched for adding predetermined amount of water (45 ml according to experimental example 1 which will be later described) and then, in step 106, the same amount of water corresponding to that value is added by actuating the pump.

In the next step 108, after the flag F is reset (0), the procedure moves to step 110. In this case, if in step 100 or step 102, if it was determined in the negative, that is, it was determined that the time period for adding water was not due or that there was no need to add water, then the procedure moves directly to step 110.

In step 110, it is determined whether or not it is time to add solution, and when the throughput of the photosensitive material F amounts to 50 rolls, in terms of the negative film, it is determined that the solution adding time is due and the program moves to step 112 where data on the predetermined amount of the solution to be replenished is fetched from RAM 84 and then, after an amount of the solution corresponding to the former is replenished in step 114, the procedure proceeds to step 102. On the contrary, if it was determined that the time is not due, then the procedure skips steps 112 and 114 and moves to step 102.

The above-described is the control performed while the apparatus is operating and, in this embodiment, independently from this control routine, irrespective of the operating time or shutdown time, the routine for determining whether water should be added or not, as shown in FIG. 3B, is in effect. This routine is hereinafter described in detail.

In step 200, it is determined whether the flag F is reset or not. If not, since it has already been determined that there is the need to add water, step 200 is repeated until water adding in the control routine is completed. If, in step 200, the answer is determined yes, then the procedure shifts to step 202 where the timer is reset and started. The routine then moves step 204. In step 204, the flowmeter 52 determines whether overflow was detected or not. If yes, that is, if overflow was detected, it is not necessary to add water since the treating solution within the treating tank 10 is sufficiently filled. The procedure moves to step 202 so as to set and start the timer again.

If, in step 204, the answer is determined no, that is, if overflow was not detected, the procedure moves to step 206 where it is determined whether a predetermined period of time (6 hours according to the experimental example 1, which will be later described) has passed. If no, the procedure shifts to step 204 and thereafter repeats steps 204 and 206 until the predetermined period of time passes.

If, in step 206, it is determined that the predetermined period of time has passed, then the procedure shifts to step 208 where the flag F indicating that there is need to add water is set (1). The procedure then moves to step 200. Consequently, this flag F is supposed to be set when overflow does not occur past the predetermined period of time.

As described above, irrespective of the operating time or shutdown time, evaporation loss can be handled (i.e., solution can be replenished) not only at the initial period of the shutdown time when the temperature of the treating solution is high and much water evaporates, but also when evaporation is generated due to standard operation of the apparatus by detecting the presence or absence of the overflow, to thereby hold the concentration of the treating solution approximately constant. As a result, a stable developing treatment can be achieved.

In this case, by way of example 1, the flowmeter 52 of this embodiment is attached to the overflow tank 46 of the developing tank 12 and, when no overflow is observed over 6 hours, 45 ml of water is added. As a result, GL tone turns out retained within a standard range (+0.3) and a stable development is achieved.

In addition, by way of another example 2, the flowmeter 52 according to the present embodiment, which is different from the apparatus of the embodiment, was attached to an overflow tank 46 which is used as a color paper treating tank paper for P2 (desilverizing treatment) and PS1 (rinsing treatment). When overflow was not observed for 4 hours at the time of adjusting the temperature, water of 13 ml was added to P2 and 30 ml to PS1. At this time, neither stain nor flaw took place.

Although, in this embodiment, the integrated flowrate of the flowmeter was 0 over a predetermined period of time, a predetermined amount of water was added but, alternatively, based on a previously stored map (FIG. 4A) representing the relationship between the integrated flowrate and the inferred evaporation loss of water, an inferred evaporation loss of water (amount of water to be added) may be calculated and water adding may be controlled based on this calculated value.

Figure 4A:
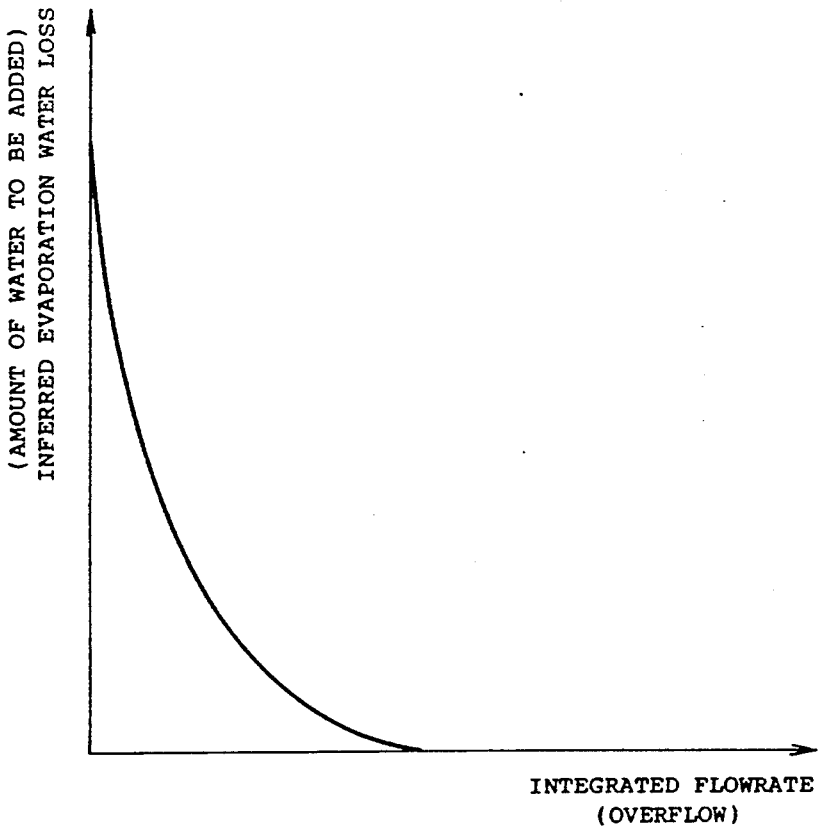
FIG. 4A is a map illustrating a relationship between the integrated flowrate and the inferred evaporation loss of water according to an modified embodiment of the present invention.

Referring to FIG. 4A, since the amount of the solution to be replenished is decided relative to the throughput of the photosensitive material, overflow of the treating solution out of the treating tank, which corresponds to the replenished amount, is decided. However, this overflow may vary with environmental conditions. If evaporation loss is decreased, then overflow is increased while if evaporation loss is increased, then overflow is decreased resulting in a change in the concentration of the treating solution. Consequently, in order to hold the concentration of the treating solution constant, when evaporation loss is decreased, the amount of water to be added is decreased. In other words, when overflow is increased, the amount of water added is decreased while, if evaporation loss is increased, then the amount of water added is increased. That is, if overflow is decreased, the amount of water added may be increased. Consequently, the map of FIG. 4A is set so that, with increasing integrated flowrate, the inferred evaporation loss, that is, the amount of water added is decreased. In addition, when the integrated flowrate exceeds the predetermined value, since it is not necessary to add water, the inferred evaporation loss is set to zero.

Figure 4B:
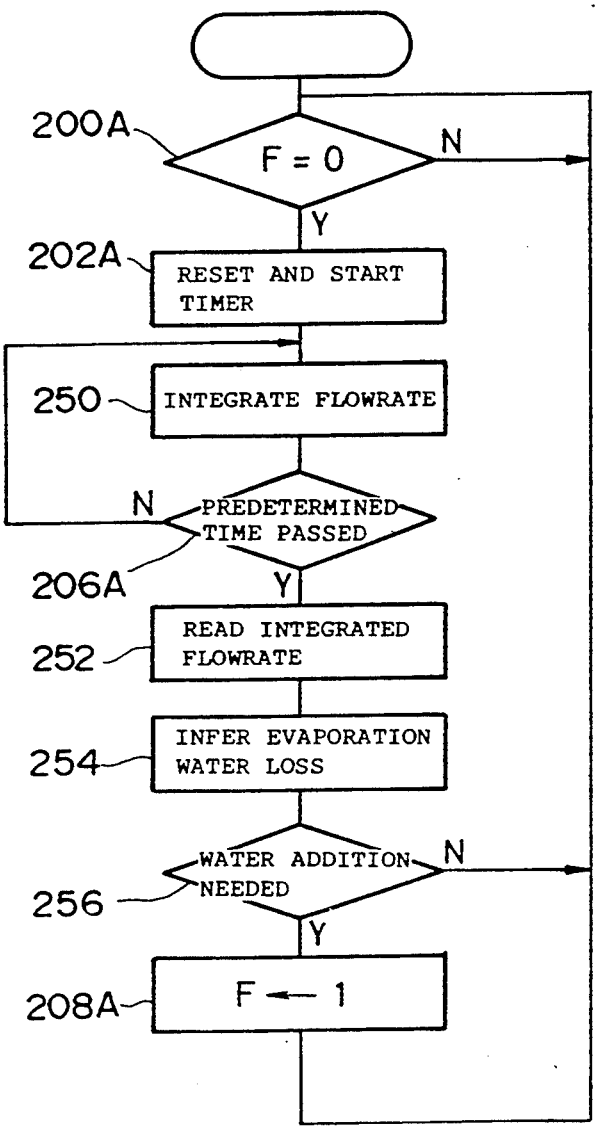
FIG. 4B is a flowchart illustrating a routine according to a modified embodiment of the present invention for determining whether water should be added or not.

How to control the addition of water is hereinafter described with reference to a flowchart of FIG. 4B. For the same control of FIG. 4B as in FIG. 3B, a sign A is affixed to the tailing end of the same number and its description is omitted. In addition, the description of the control routine for controlling the operating conditions is omitted because it is the same as in FIG. 3A. If, in step 202A, the timer is reset and started, the procedure is moved to step 250 where the flowrate detected by the flowmeter 52 is integrated for storing into RAM 84. If, in step 206A, the predetermined period of time did not pass since water adding was completed, then step 250 is repeated. If the predetermined period of time has passed, the procedure moves to step 252 to read the stored integrated flowrate. Subsequently, in step 254, an evaporation loss of water (amount of water added) based on the integrated flowrate is inferred from the map shown in FIG. 4A. The procedure then moves to step 256. In step 256, if the inferred amount of evaporated water loss is zero, it means that it is not necessary to add water. The procedure then shifts to step 200A where, if it is necessary to add water, the procedure moves to step 208A where, after the flag F is set (1), the procedure moves to step 200A.

In accordance with the above-described sequence, since an integrated flowrate (overflow) integrated over the predetermined period of time is known and, in particular, since it is possible to infer evaporation loss from the overflow at the operating time, a more precise amount of water to be added can be evaluated.

Figure 5A:
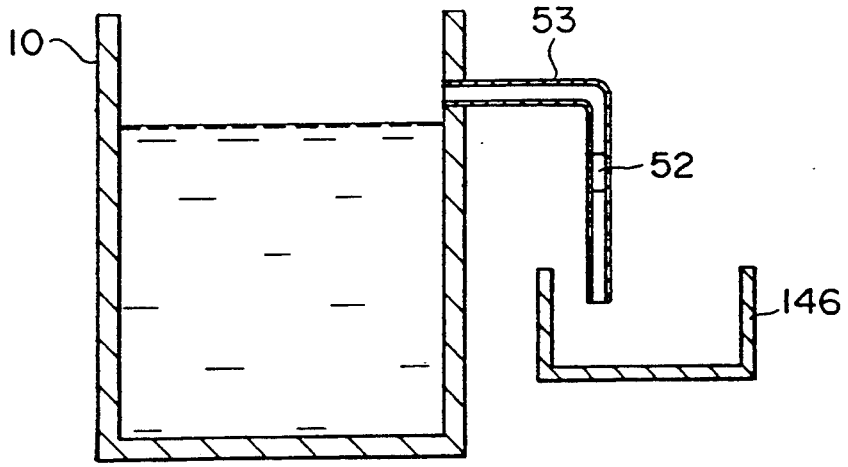
FIGS. 5A and 5B are respectively a schematic view illustrating how an overflow line according to an modified embodiment of the present invention is mounted.
Figure 5B:
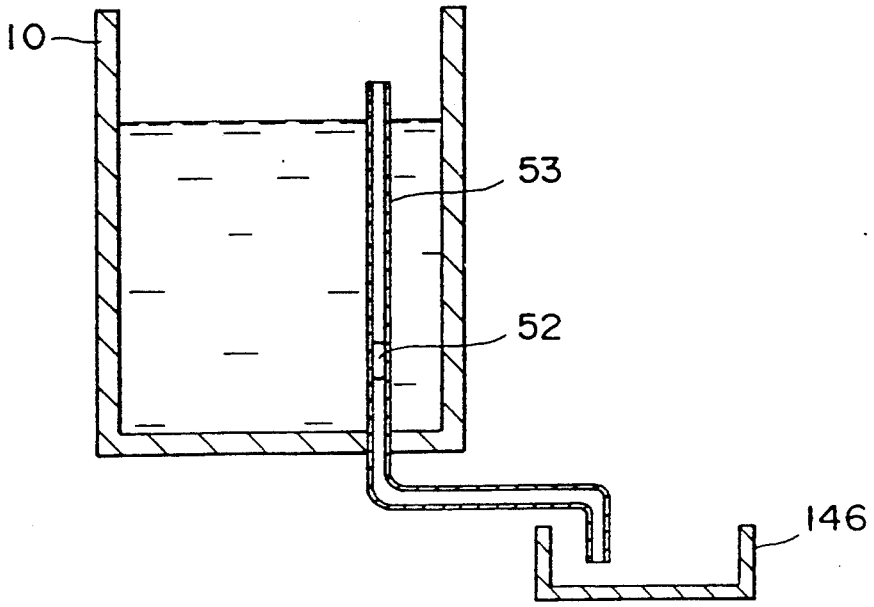
Figure 6A:
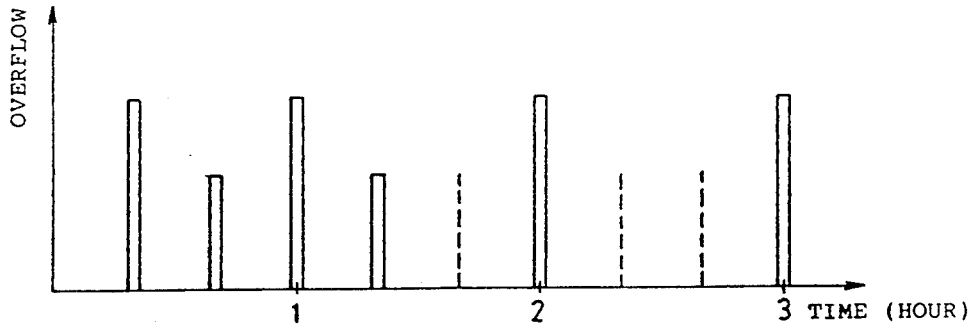
FIGS. 6A to 6C are respectively characteristic views illustrating overflow corresponding to the treating conditions.
Figure 6B:
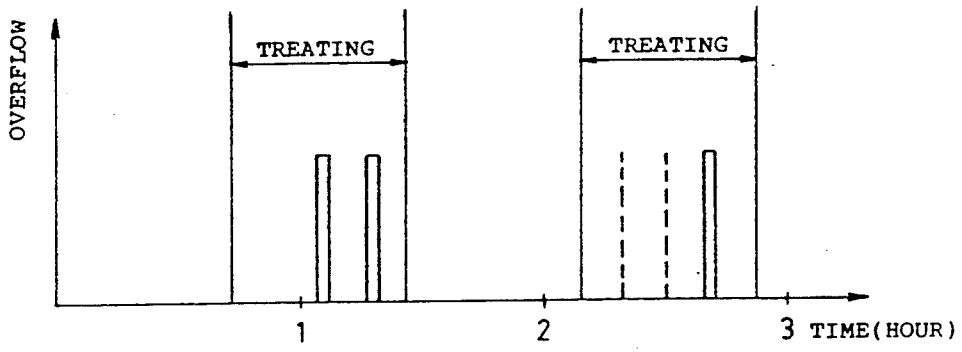
Figure 6C:
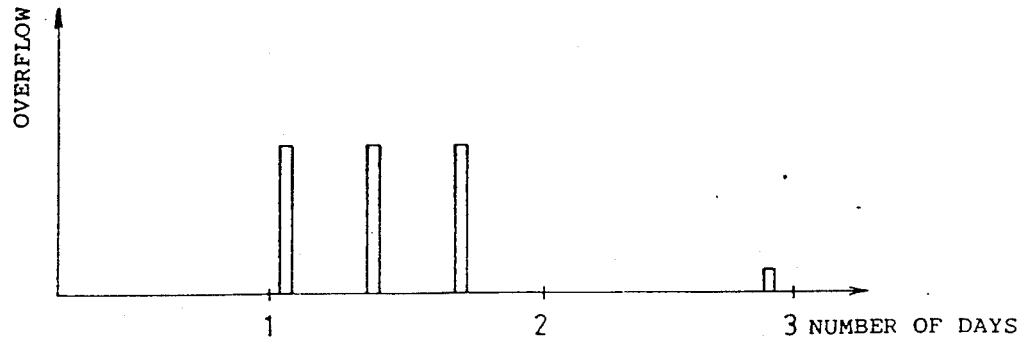

Incidentally, although, in this embodiment, the throttle portion 146A is formed within the overflow tank 146 as the overflow line, as shown in FIG. 5A, either one of the open-ended portions of the overflow line 53 may be connected to the lateral wall 50 of the treating tank 10 while the overflow tank 146 may be disposed so as to correspond to the other open-ended portion thereof. In this case, the flowmeter 52 is disposed at the intermediate portion of the overflow line 53. In addition, as shown in FIG. 5B, one end of the overflow line 53 may be passed through the bottom surface of the treating tank 10 so as to protrude above the liquid surface.

What is claimed is:

1. Method of supplying water into a treating tank of an apparatus for treating photosensitive material comprising the steps of:

a) detecting whether an overflow of a replenishing solution occurs when the replenishing solution is supplied into the treating tank; and b) supplying a first predetermined amount of water into the treating tank when the overflow is not detected after a first period of time expires.

2. Method of supplying water as set forth in claim 1 wherein if the overflow does not occur after said first predetermined amount of water has been supplied, a second predetermined amount of water is supplied after a second period of time expires.

3. Method of supplying water as set forth in claim 1 where said first predetermined amount of water is supplied into the treating tank while the apparatus is operating.

4. Method of supplying water into the treating tank of an apparatus for treating photosensitive material comprising the steps of:

a) previously setting an amount of water to be supplied into the treating tank, which corresponds to an overflow of a treating solution out of the treating tank;

b) integrating the overflow amount of the treating solution that has overflown out of the treating tank;

c) evaluating an amount of water to be supplied to the treating tank based on said integrated overflow; and d) supplying the same amount of water as said evaluated amount of water into the treating tank.

5. Method of supplying water as set forth in claim 4 wherein said amount of water to be supplied into the treating tank is conducted while the apparatus is operating.

6. Method of supplying water as set forth in claim 4 wherein said amount of water to be supplied is set so that, as the overflow is increased, the amount of water is decreased.

7. Method of supplying water as set forth in claim 4 wherein, in said step b), an overflow amount within a predetermined period of time after water has been supplied is integrated.

8. Method of supplying water as set forth in claim 6 wherein said amount of water to be supplied is zero when the overflow exceeds a predetermined amount.

9. Apparatus for treating a photosensitive material comprising:

a treating tank for accommodating a treating solution for treating photosensitive material;

an overflow tank for accommodating an overflow of the treating solution which has been accommodated within said treating tank;

a delivery means for collecting said overflow of the treating solution to deliver into said overflow tank; and a detecting means disposed inside of said delivery means for detecting either the presence or absence of or the flowrate of the treating solution passing through the interior of the delivery means.

10. Apparatus as set forth in claim 9 wherein said delivery means is arranged with a tube one end of which passes through the bottom surface of said treating tank so as to protrude above the liquid surface thereof.

11. Apparatus as set forth in claim 9 wherein said delivery means has a throttle portion for collecting the treating solution which has overflown.

12. Apparatus as set forth in claim 11 wherein said overflow tank and said treating tank accommodating the treating solution are partitioned by a vertical wall of said treating tank.

13. Apparatus as set forth in claim 12 wherein said detecting means is disposed at said throttle portion.

14. Apparatus as set forth in claim 9 wherein said detecting means is a flowmeter.

15. Apparatus for treating a photosensitive material comprising:

a treating tank for accommodating a treating solution for treating the photosensitive material;

a detecting means for detecting whether the treating solution has overflown out of said treating tank or not;

a determining means for determining based on a result detected by said detecting means whether the overflow was detected past a predetermined period of time or not; and a supply means for supplying a predetermined amount of water into the treating tank when it was determined by said determining means that the overflow was not detected past a predetermined period of time or not.

16. Apparatus for treating a photosensitive material comprising:

a treating tank for accommodating treating solution for treating the photosensitive material;

a storage means for storing a previously determined water supply amount corresponding to the amount of treating solution overflow from said treating tank;

an integrating means for integrating an overflow of the treating solution which has overflown from said treating tank;

a measuring means for evaluating a time that has passed after water has been supplied;

a determining means for determining whether said time evaluated by said measuring means reached a predetermined period of time;

a calculating means for evaluating an amount of water to be supplied, which corresponds to said overflow integrated by said integrating means based on the content stored within said storage means when it was determined by said determining means that the predetermined period of time has passed; and a supply means for supplying into the treating tank the same amount of water as said amount of water to be supplied, which was evaluated by said calculating means.

* * * * *